US010039384B1

(12) United States Patent
Yoo

(10) Patent No.: US 10,039,384 B1
(45) Date of Patent: Aug. 7, 2018

(54) ANTI-NOISE SPRING CHAIR

(71) Applicant: Changkwon Yoo, Qingdao (CN)

(72) Inventor: Changkwon Yoo, Qingdao (CN)

(73) Assignee: Dongguan City Canaan Furniture Co., Ltd., Dongguan (CN)

( * ) Notice: Subject to any disclaimer, the term of this patent is extended or adjusted under 35 U.S.C. 154(b) by 0 days.

(21) Appl. No.: 15/472,888

(22) Filed: Mar. 29, 2017

(51) Int. Cl.
*A47C 7/02* (2006.01)
*A47C 7/34* (2006.01)
*A47C 4/02* (2006.01)

(52) U.S. Cl.
CPC ..... *A47C 7/025* (2013.01); *A47C 4/02* (2013.01); *A47C 7/347* (2013.01)

(58) Field of Classification Search
CPC ..... A47C 7/025; A47C 7/027; A47C 7/347; A47C 1/03272; A47C 3/22; A47C 7/14; A47C 3/0252
See application file for complete search history.

(56) References Cited

U.S. PATENT DOCUMENTS 421,045 A * 2/1890 Caldwell ..... A47C 3/025 248/624
1,127,413 A * 2/1915 Davis ..... A47C 3/28 248/624
1,372,991 A * 3/1921 Beadle ..... G11B 33/02 248/167
2,132,291 A * 10/1938 Fitos ..... A47C 3/025 248/415
2,799,323 A * 7/1957 Berg ..... A47C 3/025 297/284.1
3,184,227 A * 5/1965 Viall, Sr. ..... A47C 7/025 267/108
3,427,019 A * 2/1969 Brown ..... A63H 11/06 482/77
4,830,345 A * 5/1989 Mar ..... A47C 7/14 248/624
5,567,009 A * 10/1996 Fay ..... A47C 3/027 297/258.1
5,590,930 A * 1/1997 Glockl ..... A47C 3/0257 297/258.1
6,079,782 A * 6/2000 Berg ..... A47C 7/022 297/183.1
6,209,843 B1 * 4/2001 Smith, Jr. ..... A47C 3/0252 248/346.01

(Continued)

FOREIGN PATENT DOCUMENTS

FR 1305406 * 5/1961

*Primary Examiner* — Timothy J Brindley
(74) *Attorney, Agent, or Firm* — Wang Law Firm, Inc.

(57) ABSTRACT

A plurality of springs are arranged between the seat board and the underframe of the anti-noise spring chair; the top of the underframe is provided with a plurality of first seating grooves in which first mounting holes are formed; the bottom of the seat board is provided with a plurality of second seating grooves corresponding to the first seating grooves; second mounting holes are formed in the plurality of second seating grooves; first gaskets are arranged in the first seating grooves, and second gaskets are arranged in the second seating grooves; and one ends of the springs are abutted against the first gaskets, and the other ends of the springs are abutted against the second gaskets. The anti-noise spring chair effectively solves a problem that noise is generated when a spring chair is used.

5 Claims, 5 Drawing Sheets

(56) References Cited

U.S. PATENT DOCUMENTS

| | | | | |
|---|---|---|---|---|
| 6,688,689 | B1 * | 2/2004 | Thorn | A47C 3/0252 248/632 |
| 7,032,972 | B2 * | 4/2006 | Berman | A47C 7/14 297/313 |
| 7,806,479 | B2 * | 10/2010 | Jensen | A47C 9/002 248/158 |
| 7,922,247 | B2 * | 4/2011 | Dickie | A47C 7/446 297/264.1 |
| 9,661,929 | B1 * | 5/2017 | Koh | A47C 7/14 |
| 2004/0046060 | A1 * | 3/2004 | Maurer | F02M 51/0603 239/533.2 |
| 2005/0168030 | A1 * | 8/2005 | Bykov | A47C 3/0252 297/312 |
| 2006/0119154 | A1 * | 6/2006 | Lin | A47C 3/0252 297/259.4 |
| 2014/0252824 | A1 * | 9/2014 | Saint Pierre | A47C 3/04 297/239 |
| 2015/0305509 | A1 * | 10/2015 | Verdier | A47C 9/002 297/174 R |
| 2016/0367042 | A1 * | 12/2016 | Fisher | A47C 7/18 |
| 2017/0127847 | A1 * | 5/2017 | Rawls-Meehan | A47C 27/148 |
| 2017/0240236 | A1 * | 8/2017 | Enriquez | B62J 11/00 |
| 2017/0290433 | A1 * | 10/2017 | Reinhard | A47C 7/14 |

* cited by examiner

ANTI-NOISE SPRING CHAIR

FIELD OF THE INVENTION

The present invention relates to the technical field of furniture, particularly to an anti-noise spring chair.

BACKGROUND

A spring chair utilizes an elastic seat board of a workpiece to make the seat board stably vibrate in a certain elastic range so that people have comfortable feel, fatigue can be relieved to a certain degree, and thus it is popular.

At present, in order to ensure good elasticity and spring fastness, the spring chair on the market is structurally complicated to cause difficult mounting, disassembling and maintenance, consume time and labor, and generate harsh noise to influence use, and therefore the spring chair has to be changed, thereby reducing the service life of the spring chair.

SUMMARY

With respect to the disadvantages of the prior art, it is an object of the present invention to provide an anti-noise spring chair, thereby effectively solving a problem that noise is generated when the spring chair is used. The anti-noise spring chair provided by the present invention is simple and firm in structure, low in cost, cheap in price and convenient to mount, carry, disassemble and maintain.

The present invention is realized by the following technical scheme: an anti-noise chair includes a seat board and an underframe detachably connected with the seat board, wherein a plurality of springs are arranged between the seat board and the underframe, the top of the underframe is provided with a plurality of first seating grooves in which first mounting holes are formed, the bottom of the seat board is provided with a plurality of second seating grooves corresponding to the first seating grooves, second mounting holes are formed in the plurality of second seating grooves, first gaskets are arranged in the first seating grooves, second gaskets are arranged in the second seating grooves, one ends of the springs are abutted against the first gaskets, and the other ends of the springs are abutted against the second gaskets.

Preferably, the underframe includes two crossed support rods of which two ends are respectively provided with three first seating grooves.

Preferably, cross bars are arranged between the two support rods.

Preferably, the center of the top of the underframe is provided with a third seating groove in which a third mounting hole is formed, the bottom of the seat board is provided with a fourth seating groove corresponding to the third seating groove, a fourth mounting hole is formed in the fourth seating groove, a third anti-noise gasket is arranged in the third seating groove, a fourth anti-noise gasket is arranged in the fourth seating groove, one end of the spring is abutted against the third anti-noise gasket, and the other end of the spring is abutted against the fourth anti-noise gasket.

Preferably, the cross sections of spring wires of the springs are circular.

Preferably, the outsides of the springs are sleeved with protection dome covers.

The present invention has the beneficial effects that an anti-noise spring chair includes a seat board and an underframe detachably connected with the seat board, wherein a plurality of springs are arranged between the seat board and the underframe, the top of the underframe is provided with a plurality of first seating grooves in which first mounting holes are formed, the bottom of the seat board is provided with a plurality of second seating grooves corresponding to the first seating grooves, second mounting holes are formed in the plurality of second seating grooves, first gaskets are arranged in the first seating grooves, and second gaskets are arranged in the second seating grooves, one ends of the springs are abutted against the first gaskets, and the other ends of the springs are abutted against the second gaskets; and the anti-noise spring chair effectively solves a problem that noise is generated when the spring seat chair is used, and is simple and firm in structure, low in cost, cheap in price, convenient to mount, carry, disassemble and maintain.

Figure 1:
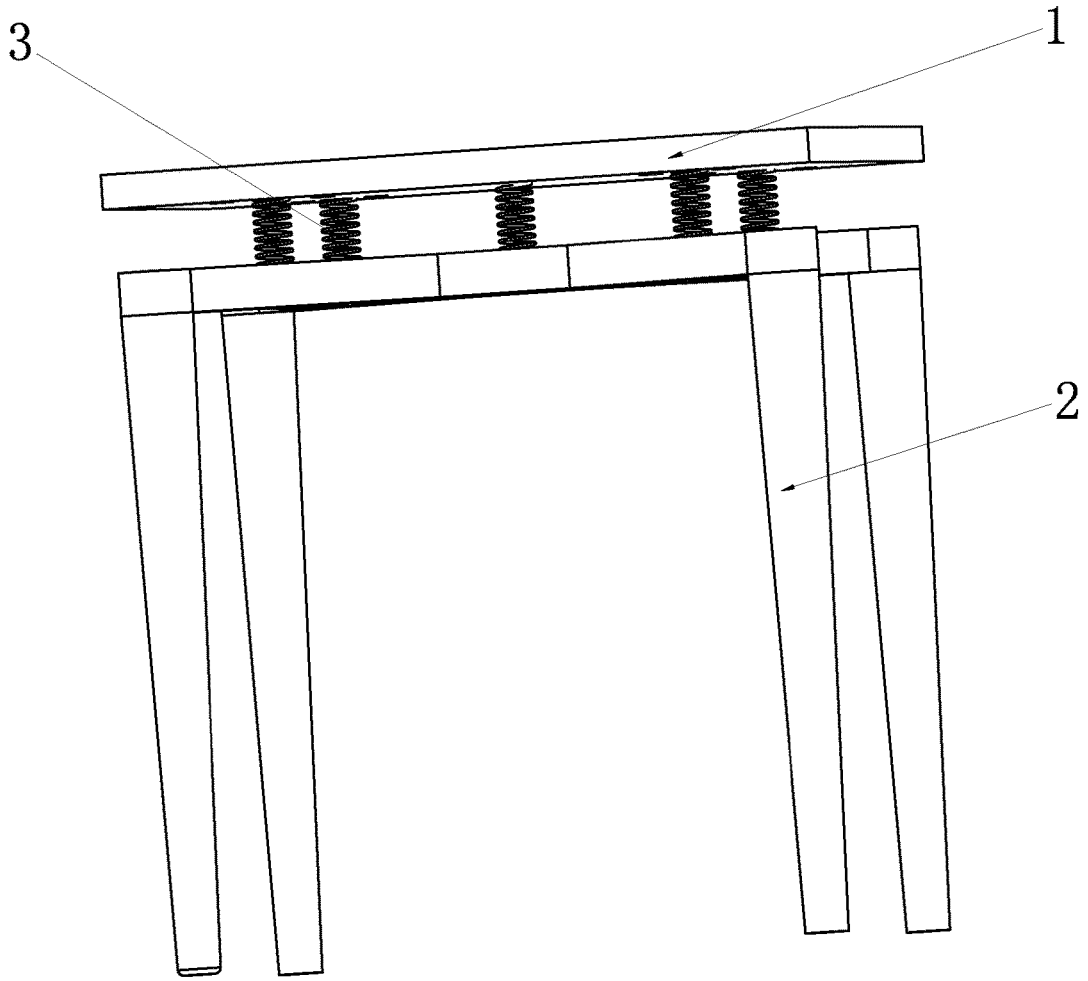
FIG. 1 is a stereostructure diagram according to the present invention.

Reference numbers are as follows:

| | |
|---|---|
| 1-seat board | 2-underframe |
| 21-support rod | 22-cross bar |
| 3-spring | 41-first seating groove |
| 42-first mounting hole | 43-first gasket |
| 51-second seating groove | 52-second mounting hole |
| 53-second gasket | 61-third seating groove |
| 62-third mounting hole | 63-third anti-noise gasket |
| 71-fourth seating groove | 72-fourth mounting hole |
| 73-fourth anti-nose gasket | 8-protection dome cover |

DETAILED DESCRIPTION

The present invention will be further described below in conjunction with FIG. 1 to FIG. 5 and specific implementations.

As illustrated in FIG. 1 to FIG. 4, an anti-noise spring seat includes a seat board 1 and an underframe 2 detachably connected with the seat board 1, a plurality of springs 3 are arranged between the seat board 1 and the underframe 2, wherein the top of the underframe 2 is provided with a plurality of first seating grooves 41 in which first mounting holes 42 are formed, the bottom of the seat board 1 is provided with a plurality of second seating grooves 51 corresponding to the first seating grooves 41, second mounting holes 52 are formed in the plurality of second seating grooves 51, first gaskets 43 for cancelling noise are arranged in the first seating grooves 41, second gaskets 53 for cancelling noise are arranged in the second seating grooves 52, one ends of the springs 3 are abutted against the first gaskets 43, and the other ends of the springs 3 are abutted against the second gaskets 53.

The seat board 1 and the underframe 2 of the present invention are made of wood, and bolts and the springs 3 which are used for connecting the seat board 1 and the underframe 2 are made of iron, the two materials can touch each other during use to cause noise of collision and friction. In this embodiment, when the spring chair is assembled, the second gaskets 53 are placed in the second seating grooves 51 of the seat board 1 firstly, the first gaskets 43 are placed in the first seating grooves 41 of the underframe 2, then the springs 3 are placed, one ends of the springs 3 are abutted against the first gaskets 43, the other ends of the springs 3 are abutted against the second gaskets 53, then the bolts are mounted, the bolts penetrate from the first mounting holes 42, then successively penetrate through the first gaskets 43, the springs 3 and the second gaskets 53 and finally penetrate into the second mounting holes 52, the first mounting holes 42 are through holes, the second mounting holes 52 are blind holes and are provided with internal threads, and the bolts are in threaded connection with the second mounting holes 52 to realize the fixed connection of the seat board 1 and the underframe 2.

The first gaskets 43 and the second gaskets 53 function to effectively buffer the collision of wood and iron so as to reduce noise of collision and friction due to touch in the process of using the two materials, so that the present invention can effectively solve the problem that noise is generated when the spring chair is used; the two ends of the springs 3 are respectively seated in the first seating grooves 41 and the second seating grooves 51 without displacement, so that the anti-noise spring chair provided by the present invention is firm in structure; and according to the present invention, the bolts are adopted to fix the seat board 1 and the underframe 2, so disassembling and assembling are convenient.

A user of the anti-noise spring chair can seat on the seat board 1, and shakes front and back, up and down, and left and right to relieve the fatigue of vertebral column.

The anti-noise spring chair can be carried in a detachable and splitting manner, so logistics fees are reduced.

Figure 2:
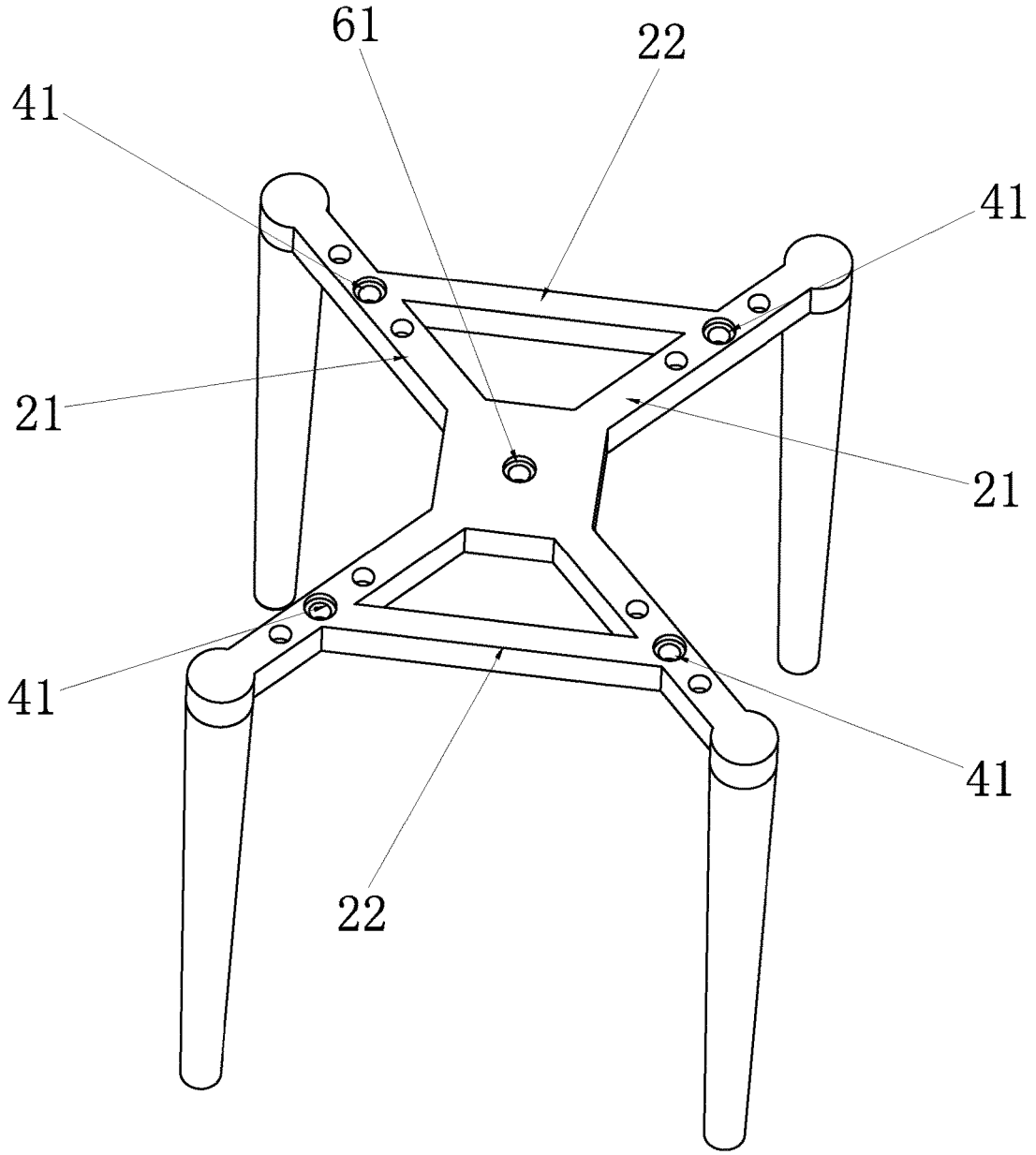
FIG. 2 is a stereostructure diagram of an underframe according to the present invention.
Figure 3:
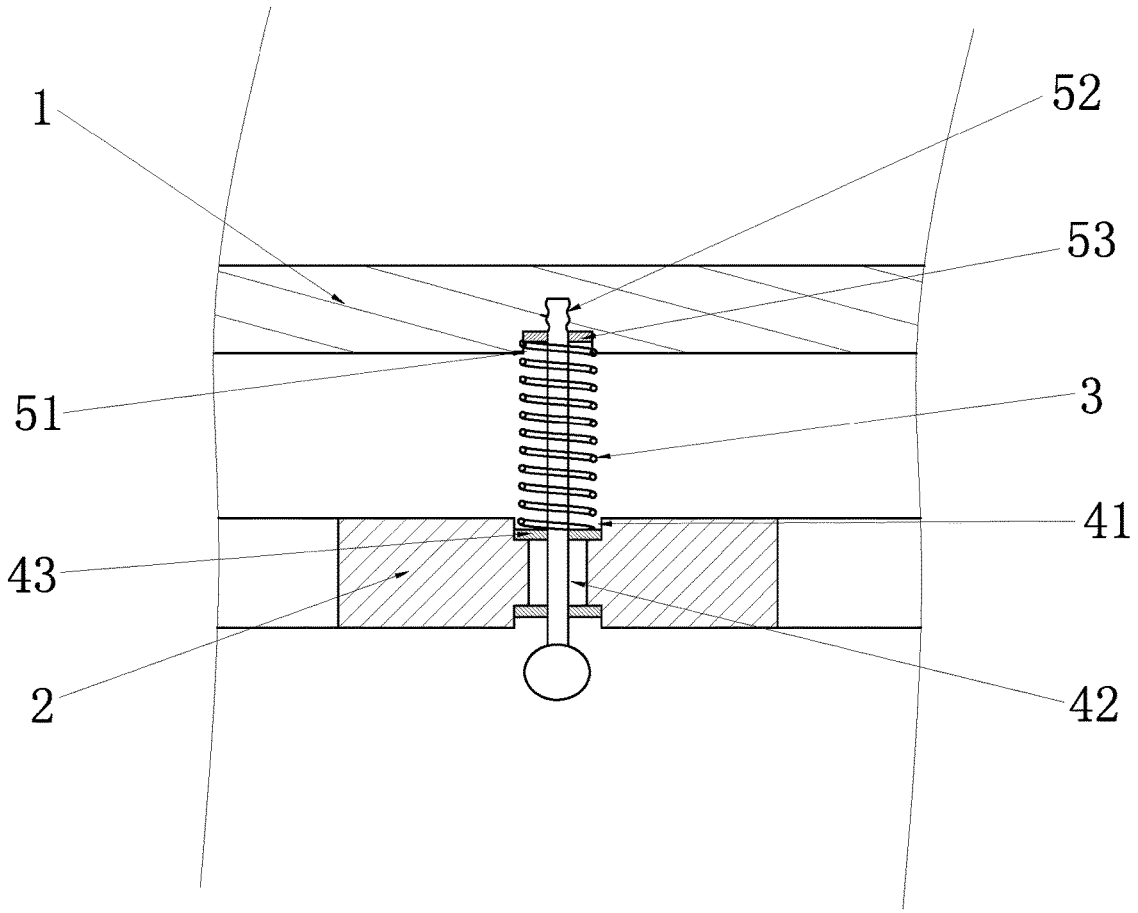
FIG. 3 is a sectional structure diagram of first seating grooves and second seating grooves during assembling according to the present invention.
Figure 4:
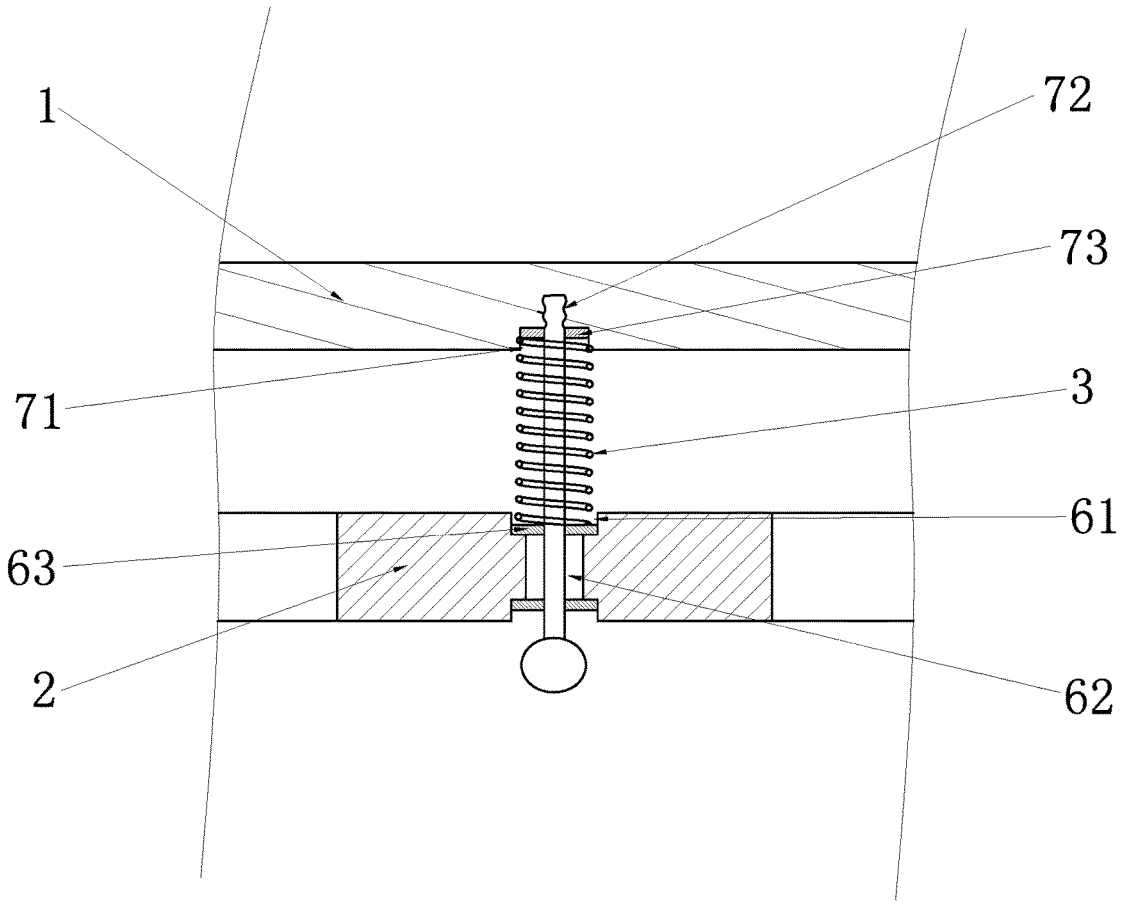
FIG. 4 is a sectional structure diagram of a third seating groove and a fourth seating groove during assembling according to the present invention.

In this embodiment, the underframe 2 includes two crossed support rods 21 of which the two ends are provided with the plurality of first seating grooves 41, when assembling of the seat board 1 and the underframe 2 are performed, the positions of the first seating grooves 41 can be determined depending on the weight of the user, the first seating grooves 41 can bear the weights of different people if being matched with the springs 3 having different thickness and height standards, the first seating groove 41 which is more closer to the center position of the seat board 1 can bear smaller weight, instead, the first seating groove 41 which is more far away from the center position of the seat board 1 can bear bigger weight. As illustrated in FIG. 2, if the weight of the user ranges from 20 kg to 80 kg, the first seating groove 41 close to the inside can be selected to perform assembling; if the weight of the user ranges from 40 kg to 100 kg, the first seating groove 41 located in the middle can be selected to perform assembling; and if the weight of the user ranges from 60 kg to 200 kg, the first seating groove 41 located at the outside can be selected to perform assembling.

In this embodiment, the cross bars 22 are arranged between the two support rods 21 to enhance the strength of the underframe 2 so that the underframe 2 can bear a heavier user.

In this embodiment, the center of the top of the underframe 2 is provided with a third seating groove 61 in which a third mounting hole 62 is formed, the bottom of the seat board 1 is provided with a fourth seating groove 71 corresponding to the third seating groove 61, a fourth mounting hole 72 is formed in the fourth seating groove 71, a third anti-noise gasket 63 is arranged in the third seating groove 61, a fourth anti-noise gasket 73 is arranged in the fourth seating groove 71, one end of the spring 3 is abutted against the third anti-noise gasket 63, and the other end of the spring 3 is abutted against the fourth anti-noise gasket 73. In the present invention, four springs for connecting the seat board 1 with the underframe 2 are distributed on four corners of the seat board 1, when the user seats on the spring chair and shakes at random, the spring on one of corners bears a force, in this way, it is easy to damage a connection structure of one of the springs and the seat board 1 as well as the underframe 2, and thus, a spring structure is additionally arranged in the middle of the seat board 1 and in the middle of the underframe 2, when in design, the length of the spring 3 in the middle is slightly longer than the lengths of the springs 3 on the four corners, when the user seats, the spring structure in the middle firstly bears the force, and then the spring structures on the four corners bear forces, so as to balance the forces of the four corners, thereby prolonging the service life of the spring chair.

When the user seats on the seat board 1, the seat board 1 overcomes resistance generated by deformation of the springs 3 to be pressed downwardly, the bolts move downwardly along with the seat board 1, the bolts generate friction with the spring wires of the springs 3 when moving downwardly, hence, in this embodiment, the cross sections of the spring wires of the spring 3 are circular, and a friction force is reduced.

The heads of the bolts adopted by the present invention are of spherical shapes, which is intended to prevent the anti-noise gasket from being damaged when moving; it is only when penetrating into the end parts of the second mounting holes 52 that the rod parts of the bolts are provided with external threads, the surfaces of the other positions of the rod parts are smooth surfaces so as to reduce friction forces generated between the rod parts and the spring wires of the springs 3 and noise generated by friction.

There are certain gaps between the bolts and the underframe 2, so that when the user shakes the spring chair back and forth, the bolts cannot touch the inner wall of the underframe 2.

Figure 5:
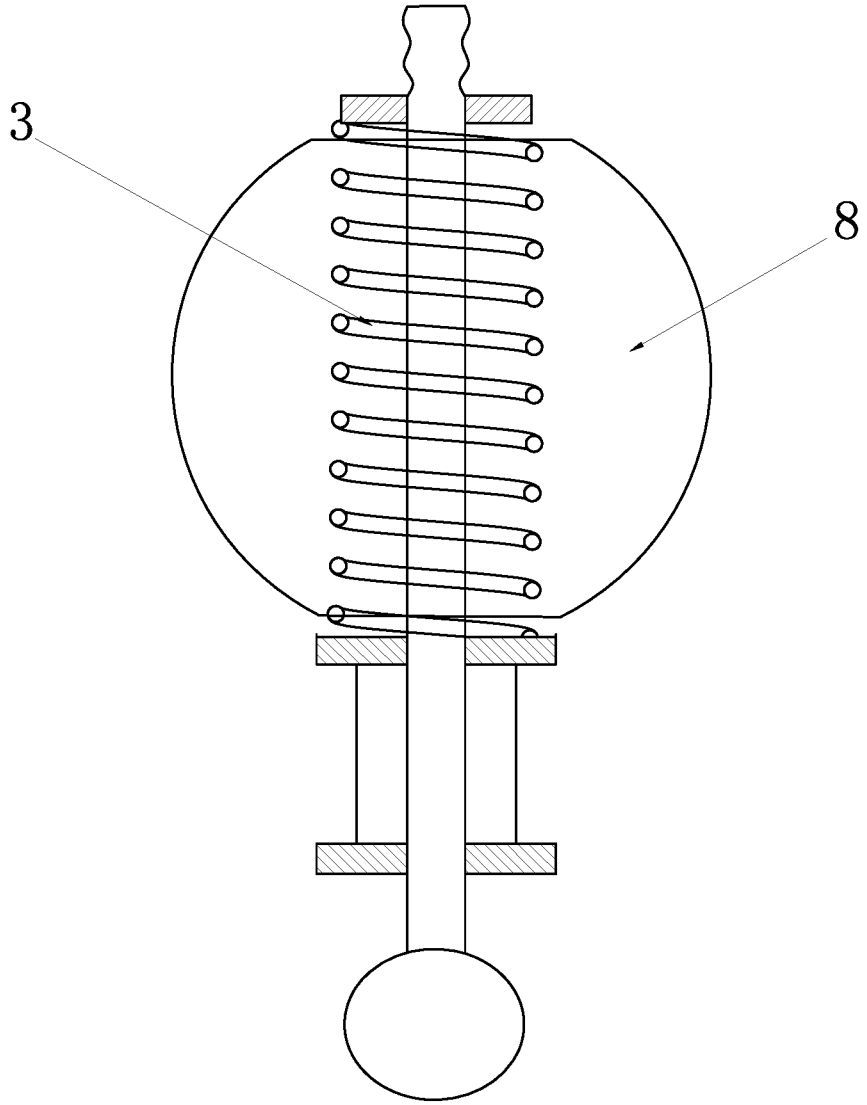
FIG. 5 is an assembling structure diagram of springs and protection dome covers.

As illustrated in FIG. 5, in this embodiment, the outsides of the springs 3 are sleeved with protection dome covers 8 which are made of sponge and have the following uses: 1, the springs 3 are protected to prevent the springs 3 from adhering dust or water to cause rustiness; and 2, when the chair is used, the springs stretch and generate friction with the protection dome covers 8 but noise does not occur.

The above descriptions are merely preferred embodiments of the present invention, for those skilled in the art, variations of specific implementations and application scopes are made according to the spirit of the present invention, this specification should not be construed as limit of the present invention.

The invention claimed is:

1. An anti-noise spring chair, comprising a seat board and an underframe detachably connected with the seat board, a plurality of springs being arranged between the seat board and the underframe, wherein a top of the underframe is provided with a plurality of first seating grooves in which first mounting holes are formed, a bottom of the seat board is provided with a plurality of second seating grooves corresponding to the first seating grooves, second mounting holes are formed in the plurality of second seating grooves, first gaskets for cancelling noise are arranged in the first seating grooves, second gaskets for cancelling noise are arranged in the second seating grooves, one ends of the springs are abutted against the first gaskets, and the other ends of the springs are abutted against the second gaskets;

wherein the underframe comprises two crossed support rods each having two halves on opposite sides of a center, the crossed support rods crossing at their respective centers, and each side of the two crossed support rods having three first seating grooves disposed thereupon.

2. The anti-noise spring chair according to claim 1, wherein cross bars are arranged between the two support rods.

3. The anti-noise spring chair according to claim 1, wherein the center of the top of the underframe is provided with a third seating groove in which a third mounting hole is formed, the bottom of the seat board is provided with a fourth seating groove corresponding to the third seating groove, a fourth mounting hole is formed in the fourth seating groove, a third anti-noise gasket is arranged in the third seating groove, a fourth anti-noise gasket is arranged in the fourth seating groove, one end of the spring is abutted against the third anti-noise gasket, and the other end of the spring is abutted against the fourth anti-noise gasket.

4. The anti-noise spring chair according to claim 1, wherein the cross sections of spring wires of the springs are circular.

5. The anti-noise spring chair according to claim 1, wherein the outsides of the springs are sleeved with protection dome covers.

* * * * *